US009863188B2

(12) United States Patent
Elshafei et al.

(10) Patent No.: US 9,863,188 B2
(45) **Date of Patent: *Jan. 9, 2018**

(54) MULTI-MOTOR STEERABLE DRILLING SYSTEM AND METHOD

(71) Applicants: King Fahd University of Petroleum and Minerals, Dhahran (SA); King Abdulaziz City for Science and Technology, Riyadh (SA)

(72) Inventors: Moustafa Elshafei, Dhahran (SA); Amar Khoukhi, Dhahran (SA); Abdulaziz Al-Maged, Dhahran (SA); Mohammad Talib, Dhahran (SA)

(73) Assignees: King Fahd University of Petroleum and Minerals, Dhahran (SA); King Abdulaziz City for Science and Technology, Riyadh (SA)

( * ) Notice: Subject to any disclaimer, the term of this patent is extended or adjusted under 35 U.S.C. 154(b) by 0 days.

This patent is subject to a terminal disclaimer.

(21) Appl. No.: 15/488,258

(22) Filed: Apr. 14, 2017

(65) Prior Publication Data

US 2017/0218706 A1 Aug. 3, 2017

Related U.S. Application Data

(63) Continuation of application No. 14/293,666, filed on Jun. 2, 2014, now Pat. No. 9,657,521.

(51) Int. Cl.

| | |
|---|---|
| ***E21B 7/06*** | (2006.01) |
| ***E21B 4/02*** | (2006.01) |
| ***E21B 4/04*** | (2006.01) |
| ***E21B 4/16*** | (2006.01) |

(52) U.S. Cl.
CPC ..... *E21B 7/068* (2013.01); *E21B 4/02* (2013.01); *E21B 4/04* (2013.01); *E21B 4/16* (2013.01)

(58) Field of Classification Search
CPC ..... E21B 4/16; E21B 7/068
See application file for complete search history.

(56) References Cited

U.S. PATENT DOCUMENTS

| | | | |
|---|---|---|---|
| 1,612,338 | A | 12/1926 | Wilson |
| 2,241,712 | A | 5/1941 | McNamara |
| 3,161,243 | A | 12/1964 | Davis |

(Continued)

FOREIGN PATENT DOCUMENTS

| | | |
|---|---|---|
| DE | 0 828 914 T1 | 10/1998 |
| WO | WO2012/041084 | 4/2012 |

*Primary Examiner* — Blake E Michener

(74) *Attorney, Agent, or Firm* — Oblon, McClelland, Maier & Neustadt, L.L.P.

(57) ABSTRACT

A directional drilling system consisting of a four-motor drilling head for better steering in directional drilling and vertical/horizontal drilling is developed. The rotational speed of each motor is independently controlled. The use of four motors in coordination with other traditional drilling variables allow precise control of the drilling direction and optimization of the rate of penetration (ROP). The top and right motors rotate in opposite directions to the bottom and left rotors to stabilize the roll rotation of the drilling head. Inclination (pitch) movement is obtained by increasing/decreasing the speed of the top motor while decreasing/increasing the speed of the lower motor. The Azimuth (yaw) movement is obtained similarly using the right and left motors. The drilling power is derived from down hole motors. A drill string transmits the drilling fluid and force on bit.

9 Claims, 11 Drawing Sheets

(56) References Cited

U.S. PATENT DOCUMENTS

| | | | |
|---|---|---|---|
| 3,169,590 | A | 2/1965 | Thatcher |
| 3,195,661 | A | 7/1965 | Jackson |
| 3,356,167 | A | 12/1967 | Trent |
| 3,509,949 | A | 5/1970 | Kukihara |
| 3,593,811 | A | 7/1971 | Tedrow |
| 3,770,067 | A | 11/1973 | Ikeda |
| 3,945,445 | A | 3/1976 | Ikeda |
| 4,059,165 | A | 11/1977 | Clark |
| 5,931,239 | A | 8/1999 | Schuh |
| 8,469,117 | B2 | 6/2013 | Pafitis et al. |
| 2001/0006120 | A1 | 7/2001 | Miyamoto |
| 2006/0102388 | A1 | 5/2006 | Dennis |
| 2007/0023204 | A1 | 2/2007 | Mocivnik |

MULTI-MOTOR STEERABLE DRILLING SYSTEM AND METHOD

The present application is a continuation application of Ser. No. 14/293,666, now allowed, having a filing date of Jun. 2, 2014.

BACKGROUND OF THE INVENTION

Technical Field

The present invention relates to a directional drilling system comprising a four-motor drilling head driving four independent bit assemblies positioned in a front face plane of the drilling head, independently controlled rotational speed mechanisms for each motor, and an inclination or azimuth controller to decrease or increase the speed of either a bottom motor, a top motor, a right motor or a left motor; and a method of drilling using the directional drilling system Description of the Related Art The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Conventional boring techniques traditionally operate with a boring device or machine that pushes and/or rotates a drill string consisting of a series of connected drill pipes with a directable drill bit to achieve an underground path or direction through which a conduit or utility device can be installed. Traditional methods of drilling include a drill body and a drill blade that is usually concentric in design and creates a cylindrical hole about the same diameter as the drill blade. Traditional methods and devices typically use high pressure high velocity jetting to steer and cool the drill body and blade.

Wells are drilled directionally for several purposes. These purposes include increasing the exposed section length through the reservoir by drilling through the reservoir, drilling into the reservoir where vertical access is difficult or not possible, allowing more wellheads to be grouped together on one surface location, and drilling along the underside of a reservoir-constraining fault to obtain multiple productive positions.

Most directional drillers are given a preplanned well path to follow that is determined by engineers and geologists before the drilling commences. When the directional driller starts the drilling process, periodic surveys are taken with a downhole instrument to provide survey data (inclination and azimuth) of the well bore. These measurements are typically taken at intervals between 30-500 feet, with 100 feet common during active changes of angle or direction. Modern directional drilling (DD) systems include a downhole MWD (measurement while drilling) tool to provide continuously updated measurements used for real-time adjustments.

These MWD data indicate if the well is following the planned path and whether the orientation of the drilling assembly is causing the well to deviate as planned. Corrections are regularly made by adjusting rotation speed or the drill string weight (weight on bit).

One of the basic problems of a directional driller is to accurately set a specific tool face orientation. After a connection, the driller must rotate the pipe at the surface and experiment with the weight-on-bit and top drive quill position to orient the tool face. The driller has to work with throttles, clutches, brakes, and a forward or reverse control to orient the drill pipe to the correct position. The challenge is to properly orientate the down hole tool to steer the well bore in a desired direction.

The most common method of drilling oil wells consists of rotating a cutting bit comprising individual cone bits which is attached at the bottom of a hollow drill string of pipe and drill collars to progressively chip away the layers of earth. To force the chips of rock and earth formation to the surface, the common practice has been to force a fluid known as "drilling mud" or "drilling fluid" down the hollow drill string, thence outwardly between the cutting teeth to clear the teeth of accumulated dirt, and thence out into the annulus formed between the wall of the well which is being drilled and the exterior of the drill string. The mud picks up the chips of rock and earth and carries them with it to the surface to clear the well as it is drilled progressively deeper.

A typical cutter layout comprises three conical cutters of a rolling cone drill bit. The cutters are located in a non-planar relationship and are typically tilted inward or outward. Each cutter comprises a generally conical body upon which are circumferentially located raised insert lands arranged circumferentially around the conical surface of the cutter. Hard metal cutting elements, commonly termed "inserts", are located in cylindrical bores drilled into the cones perpendicular to the surface of lands.

Drilling mud has a number of desired properties. It has a high viscosity and high density which makes it capable of carrying the cuttings from the rotating cutting bit up the annulus to the surface at a relatively low velocity of about 125 to 150 feet per minute. Should mud circulation be temporarily stopped, the settling velocity of cutting is reduced. By reason of its high density, the mud tends to buoy up the drill string thereby to reduce the strain on the drilling rig, and mud in the annulus is at a high hydrostatic pressure which is exerted outwardly against the wall of the well and helps to prevent cave-ins and blow-outs which might occur as the result of high formation pressure. Additionally, finely divided solids suspended in the drilling mud work to build a filter cake on the wall of the well, frequently termed a bore hole, thus reducing loss of mud which might otherwise filter to the formation. The mud also serves to lubricate the bore hole wall. A further attribute of mud is that of lubricating the bearings of the cone bits, and keeping them relatively cool. The mud further serves as a medium through which various types of logs are communicated to determine characteristics of the formations which have been penetrated as drilling progresses.

In oil well drilling, directional bores (other than straight) are often drilled to recover oil from inaccessible locations; to stop blowouts; to sidetrack wells; to by-pass broken drill pipe; and for various other reasons.

Conventional techniques for directional drilling in wells use a deflector in the borehole to push the bit sideways (e.g. "whipstocking"); or alternatively insert a bent joint in the drilling string (e.g. "bent subs"); or alternatively propel pressurized drill mud sideways through a nozzle in the drill to push the bit sideways (e.g. "side jetting").

The "whipstocking" process requires a series of separate operations including drilling of a pilot hole, reaming of the pilot hole to full gauge, and removal of the deflector, and is therefore a time consuming and costly process. The use of "bent subs" to produce lateral forces on the drill bit requires the use of expensive drill motors; and the "side jetting" process, using special drill bits to provide offset holes by the pressurized drill mud, does not function well in hard rock earth since the conventional mud pressures will not erode the hard rock materials.

Various forms of earth boring bits are utilized to cut through the hard material formations in the earth when forming a well bore. One general form of the drill bit utilizes one or more rolling cutters whose outer surfaces include projections such as milled teeth or cutter inserts that gouge into the formation material causing the material to disintegrate or pulverize as the cutter is rotated when the tool is turned about its axis. The rolling cutters are individually mounted to rotate about a supporting shaft or spindle typically with the axis of the spindle spaced radially from and at an incline with respect to the rotational axis of the tool. The incline of the spindle axis causes the cutter to both rotate about its axis and roll relative to the bottom of a borehole as the bit body is rotated. As a result, the cutter disintegrates a concentric ring of formation material in the bottom of the borehole.

One earlier version of the foregoing general type of rolling cutter is disclosed in U.S. Pat. No. 3,389,760. The patent discloses a rolling cone cutter supported to rotate upon a load pin which is connected at its opposite ends to a generally U-shaped support saddle. As disclosed, a number of such saddle and rolling cutter arrangements may be mounted on a single bit body for drilling a large borehole. For disintegrating formation, a multiplicity of small inserts of cemented tungsten carbide are fitted into drilled holes in each cutter body. The inserts are disposed in overlapping rows so that as the cutter is rolled over the bottom of a hole the inserts cut overlapping tracks so as to disintegrate the formation over the full width of a concentric swath defined by the length of the cutter as it is rotated around the axis of the drill bit. The cutting elements of U.S. Pat. No. 3,389,760 are in somewhat of a semi-random pattern on a smooth outer surface of the cutter. This physical arrangement of cutting elements leaves certain lateral discontinuities in the bottom hole pattern. As a result, the non-uniform succession of cutting elements often imparts an abrupt impact force during rotation of the cutter. Moreover, by design the outer surface of the cutter does not have relief grooves which initially aid in carrying away a disintegrated formation with the drilling fluid.

Ruhle (1972), U.S. Pat. No. 3,692,125, discloses a combination drilling and stimulation process for drilling oil wells. A drilling head in which the drilling mud flows outside the drilling string, which the mud carrying rock chips flows inside the inner pipe is described. The drill cones are arranged for better clearing of the rock chips. However the use of a clear solution containing calcium chloride instead of the usual drilling mud is disclosed. The solution of calcium chloride is treated with a liquified surfactant, and the mixture is forced down the annulus formed between the drill pipe and drill collars, and the wall of the drill hole. At the bottom of the well the solution passes the cutting face of the bit and picks up the chips, flushing them outwardly through the drill collars and drill pipe and out at the top. The arrangement is aimed at the traditional vertical drilling only, and did not include any means for directional drilling.

Jones (1983), U.S. Pat. No. 4,420,050, discloses an oil well drilling bit of the type utilizing hard metal inserts in the rolling cutters wherein each row of inserts on each cutter is located thereon in a sinusoidal or varying pattern rather than the strictly circumferential pattern of the prior art.

Dardick (1986) U.S. Pat. No. 4,582,147, proposes a system for directional drilling of boreholes into the earth under control of the driller at the surface, employing a rotating earth drill including a projectile firing mechanism, that is timed to non-symmetrically repetitively fire repeatedly projectiles into the earth at controlled angular positions that are offset from the axis of the drill and drill string in the desired direction of drilling, as the drill progresses into the earth, thereby to fracture and break the rock in a desired direction other than straight ahead of the drill. The advancement of the rotary drill into the bore therefore follows a controlled path in the direction desired.

To remotely control the drill to fire the projectiles at a desired offset position or location as the bit rotates, the angle of rotation of the drill string is monitored at the surface, and the firing of the projectiles is remotely controlled from the surface to be "timed" to occur when the firing mechanism is rotatively positioned at a desired angle.

Wu (1993) U.S. Pat. No. 5,230,386, (reissued Re 35,386 12/1996), discloses a method for detecting and sensing boundaries between strata in a formation during directional drilling so that the drilling operation can be adjusted to maintain the drill string within a selected stratum. The method comprises the initial drilling of an offset well from which resistivity of the formation with depth is determined. This resistivity information is then modeled to provide a modeled log indicative of the response of a resistivity tool within a selected stratum in a substantially horizontal direction. A directional (e.g., horizontal) well is thereafter drilled wherein resistivity is logged in real time and compared to that of the modeled horizontal resistivity to determine the location of the drill string and thereby the borehole in the substantially horizontal stratum. From this, the direction of drilling can be corrected or adjusted so that the borehole is maintained within the desired stratum.

Thompson (1995) U.S. Pat. No. 5,425,429, proposes a method for forming lateral boreholes from within an existing elongated shaft. A drilling unit is positioned within the existing shaft, bracing the drilling unit against a wall surrounding the existing shaft to transmit forces between the drilling unit and the medium surrounding the wall, and applying a drilling force from the drilling unit to cut through the wall of the existing shaft and form the substantially lateral borehole in the surrounding medium. The method includes an extendable insert ram within the drilling unit for extending a drill bit from the drilling unit and applying a drilling force to the drill bit to cut through the wall of the existing shaft. A supply of modular drill string elements are cyclically inserted between the insert ram and the drill bit so that repeated extensions of the insert ram further extends the drill bit into the surrounding medium to increase the length of the lateral borehole. The method has no provision for true directional steering and is not suitable for oil drilling, as the extensions of the lateral drilling string is limited by collars that can only fit within the main hole.

Saxman (1995) U.S. Pat. No. 5,429,201, discloses an improved bit design in which the drill bit includes a rolling cutter having a plurality of circumferential rows of teeth protruding from the body of the cutter. At least one of the rows of teeth is a closed-end circumferential row located on the surface of the cutter along a closed-end circumferential path. The latter is a non-circular curve defined by a surface intersecting the body of the cutter obliquely with respect to its longitudinal axis.

Gipson (1995) U.S. Pat. No. 5,439,066, discloses a method and system for translating the orientation of a length of coil tubing from a generally vertical orientation to a generally horizontal orientation, inside a well borehole and downhole of a wellhead. A first conduit is installed and suspended in a well borehole. The conduit is provided with a coil tubing bender at the downhole end of the conduit. Coil tubing is injected into the conduit through an upper packer attached to the top section of the conduit. After a section of coil tubing is injected into the conduit, an outer coil tubing seal is securely affixed to the coil tubing. The coil tubing is run to the top of the bender; the packer is closed; and high pressure fluid is introduced between the upper packer and the outer seal inside the conduit. The fluid forces the coil tubing through the bender and translates the coil tubing from a vertical to horizontal orientation. Abrasive fluid may be pumped at high pressures through the coil tubing now in the horizontal orientation, thereby creating a horizontal bore in the formation.

Hathaway (1996) U.S. Pat. No. 5,553,680, discloses a horizontal boring apparatus which is comprised of a remotely controlled drilling tool lowered from a self-contained vehicle into a previously drilled vertical shaft. The tool mills away a 360 degree band of metal casing adjacent to the desired area to be bored, and extends a hydraulic powered rotary drilling tool into the formation by extending and retracting a telescoping base while alternating stabilization of the base and bit end of the drilling tool. The tool is designed to drill a 1 inch bore hole up to 150 feet in any direction, or several directions. The tool and tool housing contain instrumentation for sensing direction, inclination, density, and temperature.

Kuenzi (2001) U.S. Pat. No. 6,308,789, discloses a drill bit that is arranged to change the direction of drilling. A cone head is rotatably mounted on a shank portion extending from an elongate housing. When the housing is rotated, the cone head generates a concave hole. When a change in direction is required, the housing is rotated a few degrees in one direction and then counter-rotated in the opposite direction. This generates a partial but redirected pilot hole that is also substantially concave in configuration. Continued full rotation causes the drill bit to follow the partial pilot hole in the new direction.

Smith (2002) U.S. Pat. No. 6,386,298, discloses a hole opener and method for using same which allows for a greater number of cone utters to be attached to the hole opener. The support structure provided by the present invention uses a barrel which is attached to the drill stem to effectively increase the diameter of the drill stem so that additional cutters may be attached to the hole opener. Using the barrel structure, the structural integrity of the tool is not compromised, and a strong support structure for the cutters is provided. The cone cutters may be removable from the barrel. The removable structure is provided by placing a bolt inside the segments which is used to mate the segment with a pocket attached to the barrel. This results in a very versatile tool in that the same boring head may be used for boring various types of materials. The barrel structure of the present invention also provides a means for trapping cones inside the barrel to prevent the cone cutters from being left inside the hole. The tapered shape of the hole opener allows it to be forced back to the point of entry after drilling in order to displace debris.

Haci et al. (2004) U.S. Pat. No. 6,802,378, discloses a method of and system for directional drilling reduces the friction between the drill string and the well bore. A downhole drilling motor is connected to the surface by a drill string. The drilling motor is oriented at a selected tool face angle. The drill string is rotated at said surface location in a first direction until a first torque magnitude without changing the tool face angle. The drill string is then rotated in the opposite direction until a second torque magnitude is reached, again without changing the tool face angle. The drill string is rocked back and forth between the first and second torque magnitudes.

Mcloughlin et al. (2004) U.S. Pat. No. 6,808,027, proposes an apparatus for selectively controlling the direction of a well bore comprising a mandrel rotatable about a rotation axis; a direction controller means comprising at least two parts configured to apply a force to said mandrel with a component perpendicular to the said rotation axis; a housing having an eccentric longitudinal bore forming a weighted side and being configured to freely rotate under gravity; and a driver for selectively varying the angle of the force relative to the weighted side of the housing about said rotation axis, the driver being configured to move the two parts independently of one another.

Sved (2004) U.S. Pat. No. 6,810,971, discloses various steerable horizontal subterranean drill bit apparatuses, which may have a drill bit, a housing and a one-bolt attachment system, or other features.

Adam et al (2007) U.S. Pat. No. 7,195,082, discloses a method of steering a fluid drilling head in an underground borehole drilling situation is provided by rotating the flexible hose through which high pressure is provided to the drilling head and providing a biasing force on the drilling head. The hose can be rotated from a remote surface mounted situation by rotating the entire surface rig (13) in a horizontal plane about a turntable (24) causing the vertically orientated portion of the hose (11) to rotate about its longitudinal axis. The biasing force can be provided in a number of different ways but typically results from the use of an asymmetrical gauging ring on the fluid drilling head.

Russell (2009) U.S. Pat. No. 7,543,658, discloses a drilling means for directional drilling in a bore hole comprising a drill pipe and a drilling head, including a slippable clutch device linking the drill pipe and said drilling head such that torque due to rotation of said drill pipe can be controllably applied to said drilling head through at least partial engagement of said clutch, and control means operable to sense an actual orientation angle of said drilling head and compare said actual orientation angle with a required orientation angle adjustably set in said control means and to control said slippable clutch such that when the actual orientation angle and the required orientation angle are the same, the slip torque of the slipping clutch equals the motor reaction torque, so maintaining the orientation angle of the drilling tool at said required orientation angle.

Al Hadhrami (2011) U.S. Pat. No. 7,958,949, discloses a technique for drilling a borehole includes obtaining data from a tool in the borehole for a plurality of positions in the borehole that is being drilled to form acquired data indicative of directional electromagnetic propagation measurements. The technique includes identifying a plurality of distances to a boundary between formations in ground from the plurality of positions in the borehole based on the measurements; identifying a trajectory of the borehole using the plurality of distances; and deciding whether to change the trajectory of the borehole using a change in the plurality of distances between the trajectory and the boundary. The trajectory of the borehole may be changed in both inclination and azimuth.

The disclosure described herein is to provide improved apparatus and control methods for directional drilling. The invention discloses mechanisms for effective steering of the drilling head by introducing four independent motor-driven drilling bits in addition to other unique features to simplify the drilling operation.

In summary, the traditional design of the drill bit attempts to utilized the rotational power of the drilling system for crushing rock while removal of debris is performed using the drilling fluid. On the other hand, the design of the drilling bits disclosed herein is such that the drill bit performs rock crushing and contributes as well to debris removal. In fact, the difference between the debris removal rates of each of the four drilling bits permits directional drilling.

The present disclosure discloses a drilling apparatus with four drilling motors. The apparatus disclosed herein eliminates the need for the current complicated techniques, and provides simple and intuitive techniques for precise drilling of the desired hole bore trajectory.

BRIEF SUMMARY OF THE INVENTION

The foregoing paragraphs have been provided by way of general introduction, and are not intended to limit the scope of the following claims. The described embodiments, together with further advantages, will be best understood by reference to the following detailed description taken in conjunction with the accompanying drawings.

One embodiment of the present invention includes a directional drilling system comprising a four-motor drilling head driving four independent drill bit assemblies.

In another embodiment the four bit assemblies of the directional drilling system are positioned in a front face plane of the drilling head.

In another embodiment four motors of the drilling system include a top motor, a bottom motor, a left motor, and a right motor.

In another embodiment the directional drilling system includes independently controlled speed mechanisms for each motor.

In another embodiment the top motor and the bottom motor rotate in opposite directions to the right motor and the left motor.

In another embodiment the bottom motor and the top motor rotate in an inclination movement.

In another embodiment the left motor and the right motor rotate in an azimuth movement.

In another embodiment the inclination movement of the four-motor drilling head is obtained by increasing or decreasing the speed of the bottom motor and the top motor.

In another embodiment the azimuth movement of the four-motor drilling head is obtained by decreasing or increasing the speed of the right motor and the left motor.

In another embodiment the drilling power for the four-motor drilling head is derived from drilling fluid forced into each motor.

In another embodiment a method for drilling using the directional drilling system is included.

In another embodiment the method includes driving a drilling head assembly to drill into a surface using four motors each connected to a drill bit assembly.

In another embodiment the method includes controlling the roll angle of the drilling head assembly in a bore hole using the rotation of the motors of the drilling head assembly.

In another embodiment the method includes transporting a drilling fluid to the drilling head assembly through a drilling string and an inner pipe of the drilling head assembly.

In another embodiment the method includes translating steering commands in the form of a desired angle, roll position or rate of penetration into control commands of the individual motors using a drilling head control panel.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
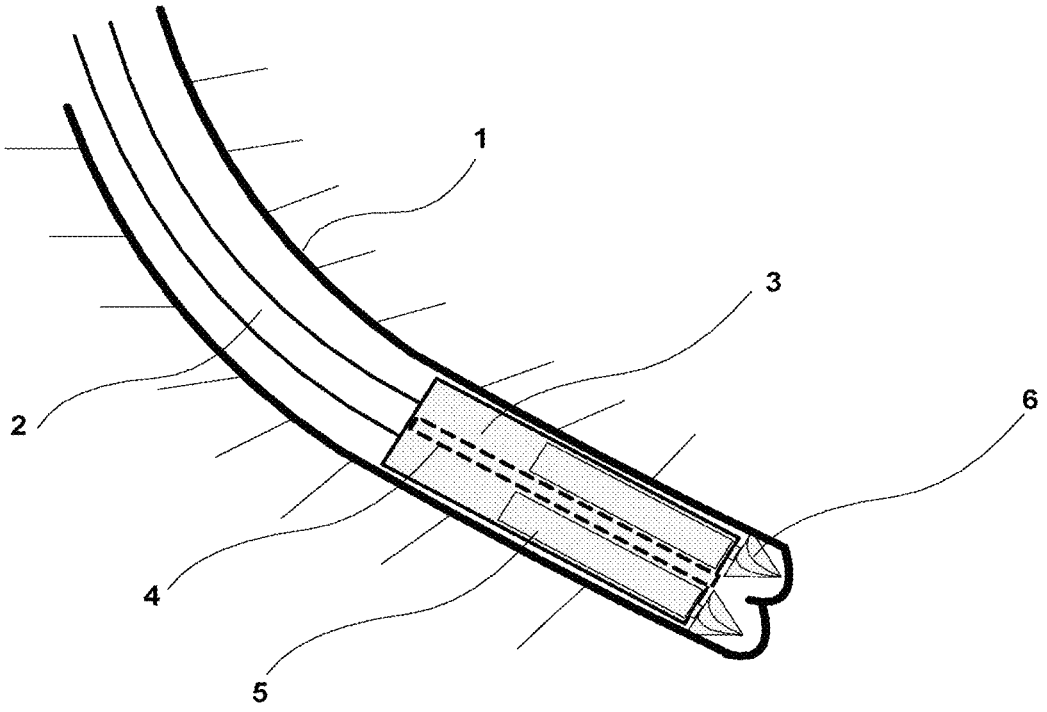
FIG. 1 is an overview of a drilling assembly.

Referring now to the drawings, wherein like reference numerals designate identical or corresponding parts throughout the several views.

The present disclosure relates to a directional drilling system consisting of a four-motor drilling head to allow for better steering in directional drilling and vertical and horizontal drilling. The rotational speed of each motor is independently controlled. The use of four motors in coordination with other traditional drilling variables allows for precise control of the drilling direction and optimization of the rate of penetration (ROP). The top and right motors rotate in opposite directions to the bottom and left rotors to stabilize the roll rotation of the drilling head. Inclination (pitch) movement is obtained by increasing or decreasing the speed of the top motor while decreasing or increasing the speed of the bottom motor. The Azimuth (yaw) movement is obtained by increasing or decreasing the speed of the right motor while decreasing or increasing the speed of the left motor. The drilling power is derived from the down hole motors. The drill string is not a rotating string. Nonetheless the drill string transmits the drilling fluid and provides force on bit (FOB). The control of the four motors allows for better management of the drilling operation subject to operational parameters and constraints and formation characteristics.

The present disclosure also includes methods for drilling with the four-motor drilling head assembly, the dynamics and kinematics of the drilling system, and control methods for inclination, azimuth, drilling head roll rotation, and ROP. The drilling system preferably includes a control panel to make the new controls conveniently available to the drilling operators as the traditional control panels do not include the control inputs described herein.

Another embodiment of the disclosure also includes a directional drilling (DD) system. DD is the process of directing the wellbore along a trajectory to a predetermined target. Directional drilling is the practice for drilling well bores along non-vertical trajectories. The present disclosure provides improved directional drilling in the applications related to oil field directional drilling and utility installation directional drilling (horizontal directional drilling).

The objective of this disclosure is to alleviate the complicated, time consuming, and expensive procedure for monitoring and correcting the direction of the drilling head, and provide simple and intuitive operator interface for interactive steering of the drilling head.

The present disclosure includes a dynamic model of the drilling head and also includes a control method to precisely follow the desired well path.

This disclosure discloses a novel steerable drilling head consisting of four motors driving four drilling bits. The drilling power is mainly coming from these down hole motors. The drill string is not rotating, but it only transmits the drilling fluid and force on bit. The use of four motors and four drill bits allow precise steering of the head by independently controlling the speed of each bit. The invention describes the dynamic model of the drilling head and control methods to precisely follow the desired well path.

Another embodiment of the invention includes a directional steering drilling assembly comprising of four motors in the bore head assembly (BHA).

FIG. 1 depicts a directional drilling system for directing the path of the wellbore 1 along a trajectory to a predetermined target. A drilling head assembly 3 and 4 is depicted comprising four motors 5 driving four independent bit assemblies 6. The speed and torque of each motor 5 can be independently controlled, causing the rate of removal of rocks and the direction of advancement of the drilling head to be precisely controlled. The drill head assembly 6 is attached to the end of the drilling string 2. The drill string 2 includes an inner pipe for carrying a drilling fluid. The use of the four motors 5 in coordination with other traditional drilling variables allows for precise control of the drilling direction and optimization of the rate of penetration (ROP).

The top and right motors rotate in opposite directions to the bottom and left motors—to stabilize the roll rotation of the drilling head. The top motor and the right motor rotate clockwise and the left motor and the bottom motor rotate counter clockwise. Pitch movement (inclination) is obtained by increasing or decreasing the speed of the top motor while decreasing or increasing the speed of the bottom motor. The yaw movement (azimuth) is obtained by increasing or decreasing the speed of the right motor while decreasing or increasing the speed of the left motor. The control of the four motors allows for better management of the drilling operation in a plurality of drilling environment and under a plurality of operational constraints.

FIG. 1 depicts a novel drilling head assembly 3 and 4 comprising four motors 5 driving four independent bit assemblies 6. The speed of each motor 5 can be independently controlled, causing the rate of removal of rocks by each bit 6 and the direction of advancement of the drilling head to be controlled. The drill head assembly is attached to the end of a drilling string 2, which includes an inner pipe for carrying the drilling fluid. The use of the four motors 5 in coordination with other traditional drilling variables allows for precise control of the drilling direction and optimization of the rate of penetration (ROP).

Figure 2:
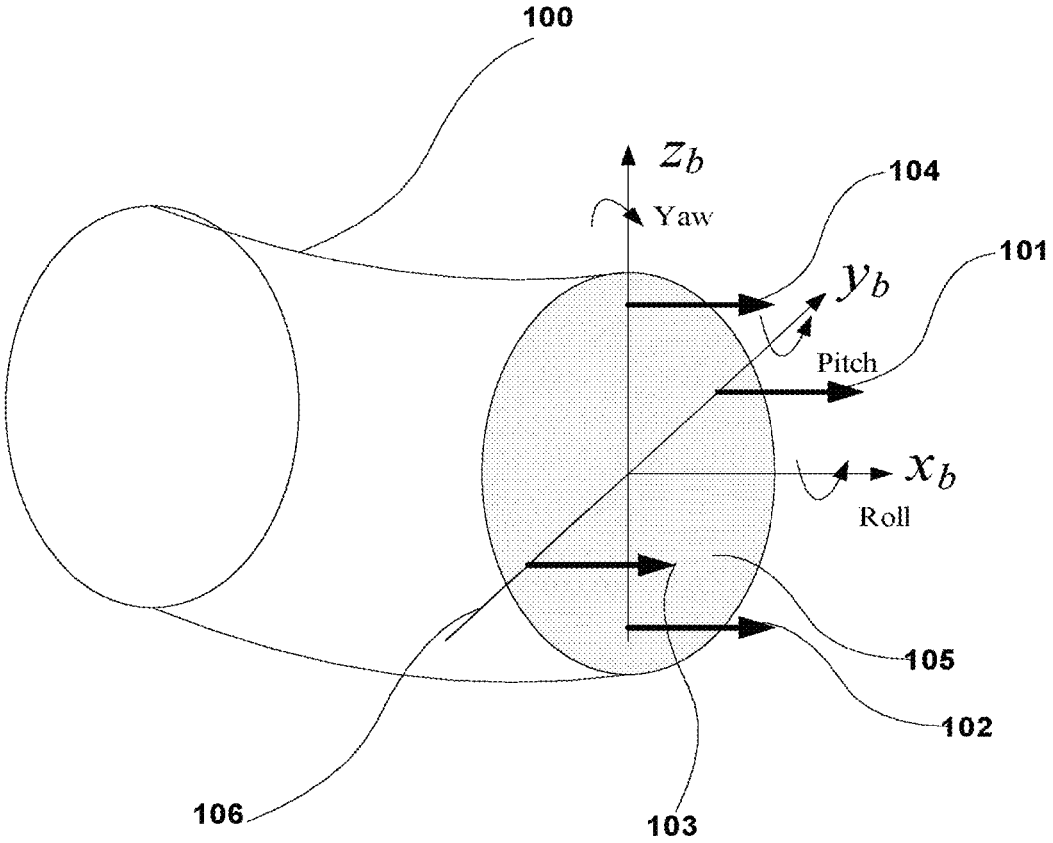
FIG. 2 depicts a reference axis and tool face of a drilling assembly.

FIG. 2 depicts a reference axis and a tool face of the drilling assembly. The axis of the hole bore 100 is aligned with the right motor thrust 103, the left motor thrust 101, the top motor thrust 104, and the bottom motor thrust 102. The 4 drill bits are arranged symmetrical with respect to three body axes {U, V, W} 106, where the W-axes indicates the direction of motion. The tool face 105 is taken to be the {U, V} plane. The left motor thrust 101 and the bottom motor thrust 102 rotate counter to the right motor thrust 103 and the top motor thrust 104 e.g., counter clock wise and clockwise, respectively. The motors may include electrical motors or hydraulic mud motors with power control and torque/rpm sensors. The directions of the body yaw (azimuth), roll and pitch (inclination) are also indicated in FIG. 2. The azimuth angle is measured in a direction about the U plane 106. The roll is measured in a direction about the W plane 106. The pitch is measured in a direction about the V plane 106.

Figure 3:
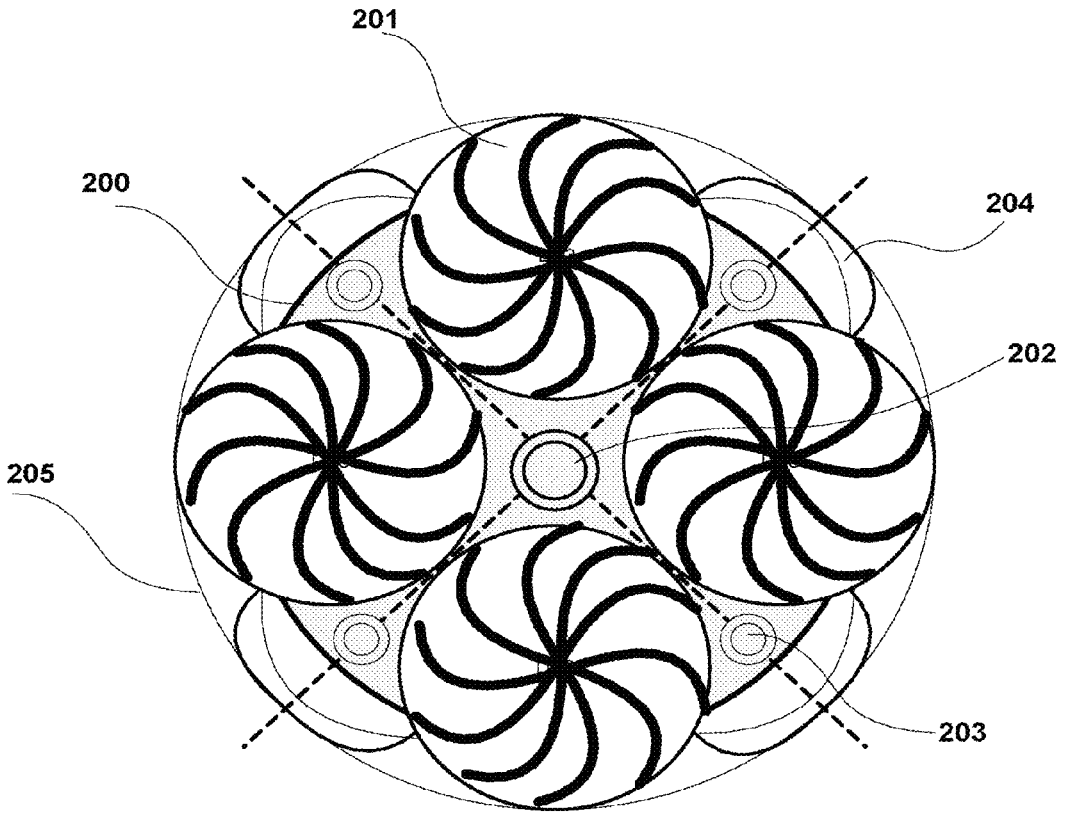
FIG. 3 depicts a drilling assemble front projection view.

FIG. 3 depicts a schematic of the bore head assembly (BHA) as projected towards the tool face. 200 is the BHA cylindrical casing, and 205 is the bore hall. The central nozzle 202 ejects the drilling fluid from the drilling assembly. The drilling fluid includes viscous materials including but not limited to drilling mud. A plurality of circumferential side nozzles 203 remove rock chips. Preferably, there are four side nozzles 203. A plurality of front chisels 204 are fixed to the drill body for crushing debris and smoothing the surface of the borehole. Preferably there are four front chisels 204. The chisels 204 help to crush rock. The drilling fluid is preferably in contact with motors' heat sinks to cool the motors. A plurality of conic drill bits 201 having twisted blades crush and remove rock. Preferably, there are four conic drill bits 201.

Figure 4:
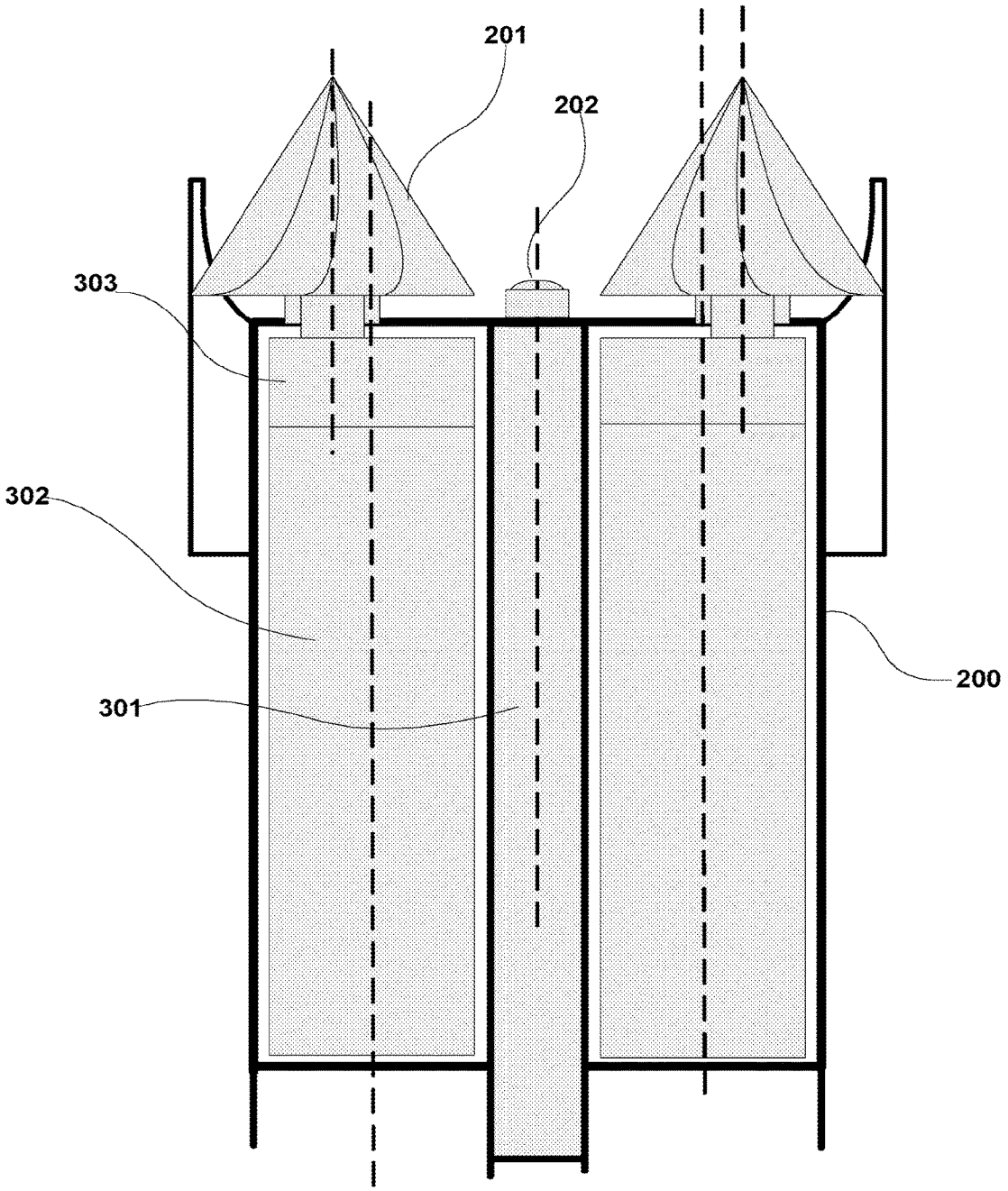
FIG. 4 depicts a side cross section view of a drilling assembly.

FIG. 4 depicts a longitudinal cross section view of the drilling head assembly showing two motors 302. In a three-dimensional view of the drilling head assembly, there are four motors included in the drilling head assembly. As depicted in FIG. 3, a body 200 is connected to the central nozzle 202. The central nozzle 202 ejects the drilling fluid as depicted in FIG. 4 through a central pipe 301 which carries the inlet mud fluid through the drilling assembly. FIG. 4 also depicts two drill bits (out of four) 201 connected to the motors via a gear box 303.

Figure 5:
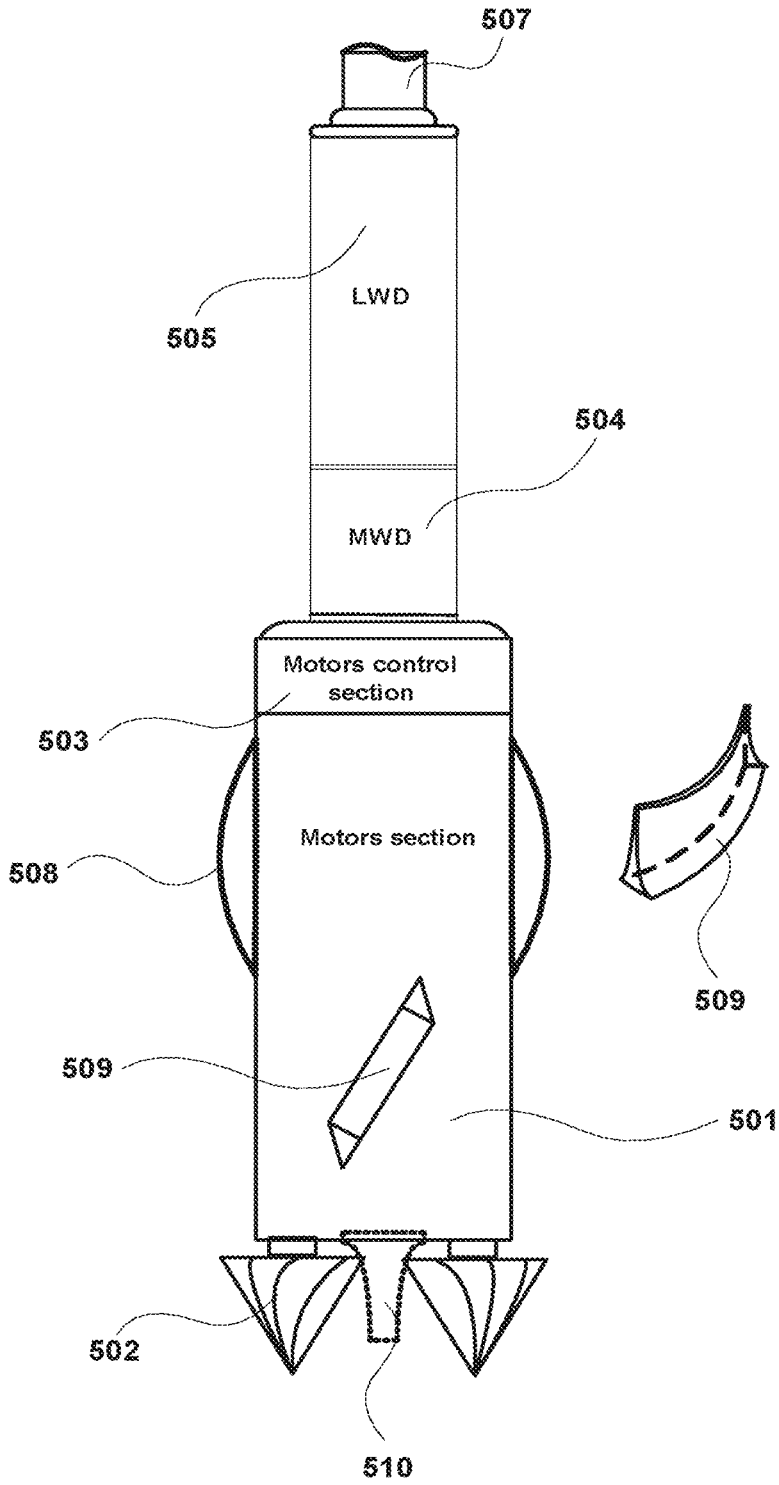
FIG. 5 depicts components of a BHA.

FIG. 5 depicts the bore head assembly. The drilling assembly includes at least one section for motor control 503 and one motor section 501 that create movement in the conic drill bits 502. Motor control 503 includes power electronics and motors control, online measurements of the drilling head angular velocity and acceleration, motors torque, motors rpm, motors power, temperatures, hydraulic pressure and differential pressure measurement and various body stresses. The drilling assembly also includes a section for conventional log while drilling (LWD) units 505 and another section for conventional MWD 504 for estimating the magnetic north and the gravitational vector.

Another embodiment of the invention includes methods for modeling the drilling assembly for simulation and control purpose comprising the dynamics and kinematics of the drilling system, rock-bit interaction, steering mechanisms interaction, and the characteristics of rock and drill bit.

The BHA as depicted in FIG. 5 may include a section for conventional measurements while drilling MWD 504, and another section for conventional log while drilling (LWD) 505, in addition to other instruments for measurement of body angular velocities and acceleration to track the orientation and position of the BHA. The MWD may include at least three perpendicular sets of accelerometers for gravity measurements to determine the vertical axis, and may include at least three magnetometers for determining the magnetic north. The accelerometers and magnetometers of MWD 504 are aligned with the BHA body axis. The BHA may also include a hydraulic generator and other motor control electronics and actuators.

Attached outside the drilling head are a plurality of sliding surfaces 508 located along the longitudinal axis in order to reduce friction during horizontal drilling. The sliding surfaces may be housed inside the drilling head casing or may be brought out when needed. Attached outside the surface of the drilling head are a plurality of smoothing surfaces 509 inclined to the longitudinal axis in order to smooth the borehole. Similarly, front chisels are also attached to drilling head to remove left over rock parts, which could be inaccessible by the four drilling bits.

In conventional oil drilling the bits are designed to achieve the best rock crushing capability. The motor torque is utilized for rock crushing, while the task of moving the debris is performed by the mud fluid jet. Unlike the conventional drill bits, the present disclosure describes a new bit design where the motor torque is converted by the bit structure to a drag torque $T_d$ and a lift force $F_L$. The drag torque contributes to crushing rock, while the lift force removes the debris and causes a forward thrust force on the BHA body.

Figure 6:
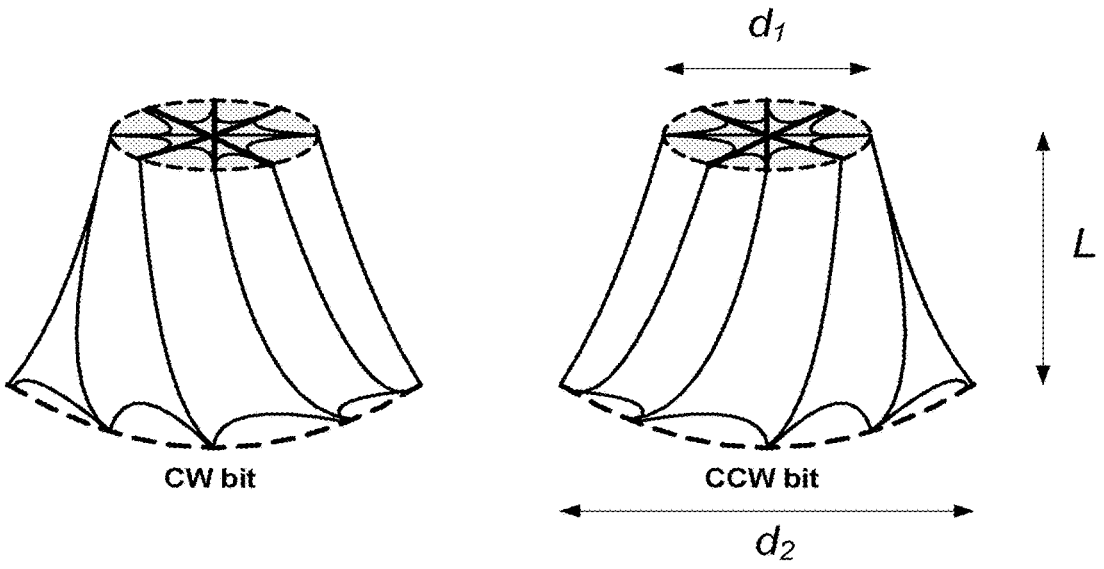
FIG. 6 depicts design parameters of drill bits.

Several designs can be used for the drill bits as shown in FIG. 6. FIG. 6 depicts a drill bit including twisted blades. The bit design parameters are:

Nb: number of blades

Vb: grove volume per blade $\tau_b$: twist angle d1, d2, and L: drill dimensions (depend on the bore diameter and rock type).

Other design features may be added to the basic design depending on the depth and rock type. For example, using wavy blades, adding inserts, and diamond parts along the edges of the blades are design features that may be added to the basic design of FIG. 6.

The steering control system is responsible for providing the control commands to the quad motors assembly to align the drilling head to the target directions in terms of desired inclination angle and azimuth angle. The control system adjusts the power of the 4 motors to achieve the desired rate of penetration ROP, and stabilizes the tool roll.

The motor torque is resolved by the drill bit into two components; a drag torque on a plane perpendicular to the bit axis ($T_D$), and a lift force ($F_L$), which moves crushed debris up through the bit helical groves. In effect, this lifting force will exert a forward thrust force on the drill head along the bit axis as shown in FIG. 2. The lift force is approximated by the relation $F_L=b\omega^2$, $F_i=b.w_i^2$ where b is the thrust factor and ω is the angular speed of the bit. The coefficient b depends on the bit geometry and the density of mud.

The second component of the bit effort is the drag torque, which is used to crush the rocks. The drag torque, $T_D$ may be approximated by the relation $T_D=d\omega^2$, where d depends on the drill bit geometry, rock density, and rock specific energy.

The four rotational velocities $w_i$ of the rotors are the input control variables, or equivalently, the motors power, $P_i$, i=1,2,3,4.

Two frames are to be considered: the inertial earth frame (observer from control room) and body fixed frame [U,V, W], The position of the drill bits in the inertial frame is given by the vector $\zeta^T=(x,y,z)$. The orientation of the 4-Motor drill bit's system is given by the three Euler angles, namely yaw angle ψ, (azimuth), Pitch angle θ (inclination) and the roll angle φ that together form the vector $\Omega=\{\theta,\psi,\varphi\}$.

It is to be assumed that the body axis UVW are aligned with the inertia axis XYZ. The body is subject to rotation ψ about the Z-axis, followed by θ about V-axis (pitch), followed by a roll rotation φ about the W axis. Accordingly, the sequence of transformation can be expressed as $$R = R_{Z,\psi} R_{V,\theta} R_{W,\phi}$$

-continued $$R = \begin{bmatrix} c\psi & -s\psi & 0 \\ s\psi & c\psi & 0 \\ 0 & 0 & 1 \end{bmatrix} \begin{bmatrix} c\theta & 0 & s\theta \\ 0 & 1 & 0 \\ -s\theta & 0 & c\theta \end{bmatrix} \begin{bmatrix} c\phi & -s\phi & 0 \\ s\phi & c\phi & 0 \\ 0 & 0 & 1 \end{bmatrix} \tag{1}$$

$$R = \begin{bmatrix} c\psi c\theta & -s\psi & c\psi s\theta \\ s\psi c\theta & c\psi & s\psi s\theta \\ -s\theta & 0 & c\theta \end{bmatrix} \begin{bmatrix} c\phi & -s\phi & 0 \\ s\phi & c\phi & 0 \\ 0 & 0 & 1 \end{bmatrix}$$

$$R = \begin{bmatrix} c\psi c\theta c\phi - s\psi s\phi & -c\psi c\theta s\phi - s\psi c\phi & c\psi s\theta \\ s\psi c\theta c\phi + c\psi s\phi & -s\psi c\theta s\phi + c\psi c\phi & s\psi s\theta \\ -s\theta c\phi & s\theta s\phi & c\theta \end{bmatrix} \tag{2}$$

The rotational matrix R defines the transformation from the body axis to the inertia axes, for a point P in space, where cθ denotes cos θ and sθ denotes sin θ.

$$P_{XYZ}=RP_{UVW}$$

The inverse transformation matrix Q is given by $$Q = R^{-1} = R^T = \begin{bmatrix} c\psi c\theta c\phi - s\psi s\phi & s\psi c\theta c\phi + c\psi s\phi & -s\theta c\phi \\ -c\psi c\theta s\phi - s\psi c\phi & -s\psi c\theta s\phi + c\psi c\phi & s\theta s\phi \\ c\psi s\theta & s\psi s\theta & c\theta \end{bmatrix} \tag{3}$$

$$P_{UVW}=QP_{XYZ}$$

The gravitational direction is measured in the MWD unit by three accelerometers aligned along the body axis. The Gravitational direction can be expressed in of the normalized accelerometer reading as:

$$\begin{bmatrix} g_{xn} \\ g_{yn} \\ g_{zn} \end{bmatrix} = Q \begin{bmatrix} 0 \\ 0 \\ 1 \end{bmatrix} g = \begin{bmatrix} -s\theta c\phi \\ s\theta s\phi \\ c\theta \end{bmatrix} g \tag{4}$$

The three relations defined in Equation (4) can be used to find the actual attitude of the BHA, $\{\theta_A,\psi_A,\varphi_A\}$. Similar equations can be derived based on the known direction of magnetic north and the measurements of magnetometers in the MWD unit. The components of the gravitational force in the body U & V directions are given by:

$$f_{gu}=-s\theta c\varphi mg$$

$$f_{gv}=s\theta s\varphi mg \tag{5}$$

Since the motion is confined to the borehole, these two components do not cause lateral movements and are cancelled by formation reaction forces. However, these two components determine the friction forces in the direction of motion and the friction torque against angular motion around w-axis as follows:

$$F_{fw}=(s\theta c\varphi mg+s\theta s\varphi mg)*\mu \tag{6}$$

Where μ is the friction coefficient (0.25~0.4)

During vertical drilling (θ=0) the friction force is negligible, while in the horizontal drilling the friction force is maximum. The friction torque is given by:

$$T_{fw}=r_{bh}(s\theta c\varphi mg+s\theta s\varphi mg)*\mu \tag{7}$$

New auxiliary variables are defined as:

$$u_1=F_{L1}+F_{L2}+F_{L3}+F_{L4}$$

$$u_2=F_{L2}-F_{L4}$$

$$u_3=F_{L1}-F_{L3}$$

$$u_4=T_{D1}-T_{D2}+T_{D3}-T_{D4} \tag{8}$$

Since the translational motion of the drilling head is confined to the body w-axes, the equation of motion can be written as:

$$m\dot{v}_w=u_1+\text{FOB}-F_{fw}+mg\cos(\theta) \tag{9}$$

Where $v_w$ is the average penetration velocity (ROP), FOB is the downward force exerted on the drill bit mainly by the weight of the drilling string and the collars, plus any additional applied force by the drilling station at the surface.

The torque equations can be written as:

$$J\ddot{\Omega}=-\dot{\Omega}\times J\dot{\Omega}-M_G+M-T_f \tag{10}$$

With the body Inertia matrix ($I_x$, $I_y$, $I_z$), the Motor+bit inertia $J_R$, the vector M describes the torque applied to the body and the vector $M_G$ of the gyroscopic torques. The gyroscopic torques depend on the rotational velocities of the rotors and hence on the vector $u^T=(u_1, u_2, u_3, u_4)$ of the transformed input variables with:

$$g(u)=\omega_1-\omega_2+\omega_3-\omega_4 \tag{11}$$

$$M_G=I_R\left(\dot{\Omega}\times\begin{bmatrix}0\\0\\1\end{bmatrix}\right)\cdot g(u)=I_R g(u)\begin{bmatrix}\dot{\theta}\\\dot{\psi}\\0\end{bmatrix} \tag{12}$$

$$M=\begin{bmatrix}L_b u_2\\L_b u_3\\L_b u_4\end{bmatrix} \tag{13}$$

Substituting in Equation (10):

$$\begin{aligned}\ddot{\psi}&=\frac{I_v-I_w}{I_u}\dot{\phi}\dot{\theta}-I_R g(u)\dot{\theta}+L_b u_2\\ \ddot{\theta}&=\frac{I_w-I_u}{I_v}\dot{\psi}\dot{\phi}-I_R g(u)\dot{\psi}+L_b u_3\\ \ddot{\phi}&=\frac{I_u-I_v}{I_w}\dot{\psi}\dot{\theta}+L_b u_4-T_{fw}\end{aligned} \tag{14}$$

The dynamic equations of the quad motor drilling head are described by equations (9) and (14). The above simplified model is adequate for simulation and control purpose. The presented dynamic equations can easily be simulated using MATLAB/Simulink for testing and validating control techniques.

Figure 7:
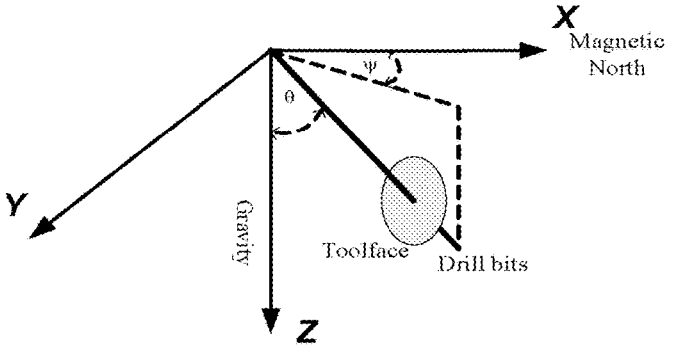
FIG. 7 depicts illustration of a tool face view.

FIG. 7 depicts an illustration of a tool face view.

Figure 8:
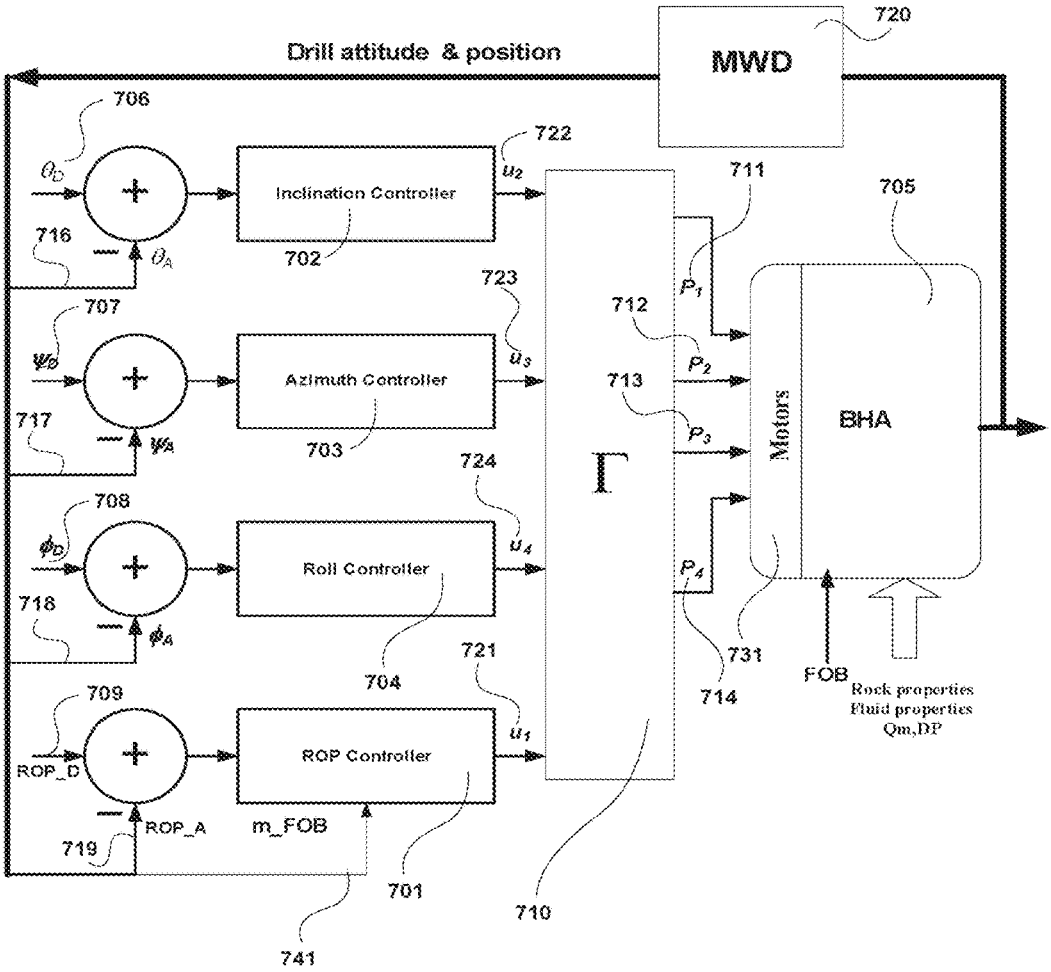
FIG. 8 depicts control loops of a quad motors steering system.

The control loops are illustrated in FIG. 8. Four control loops are involved in the steering. Control Loop 702 controls the inclination loop which includes typically a PID control loop, where the difference between the desired and actual inclination is used to adjust the auxiliary variable $u_3$. Control Loop 703 controls the azimuth control loop which includes typically a PID control loop, where the difference between the desired and actual azimuth angles is used to determine the auxiliary variable $u_2$. Control Loop 704 controls the roll stabilization loop which includes typically a PID control loop, where the roll offset is used to determine the auxiliary variable $u_4$. Control Loop 701 controls the ROP control loop, where the difference between the desired ROP and the actual ROP is used to determine the auxiliary variables $u_1$. Control Loop 4 loop is also affected by FOB (force on bit), as usually the motors are not enough to achieve the required rock crushing rate.

The desired ROB is determined by an outer optimization algorithm, which includes tool wear rate, motors power constrains, formation properties, mud fluid properties, flow rate, and hydraulic power.

The auxiliary variables $\{u_1,u_2,u_3,u_4\}$ defined in Equation 8, can be written as $$\begin{bmatrix}u_1\\u_2\\u_3\\u_4\end{bmatrix}=\begin{bmatrix}b&b&b&b\\0&b&0&-b\\b&0&-b&0\\d&-d&d&-d\end{bmatrix}\begin{bmatrix}\omega_1^2\\\omega_2^2\\\omega_3^2\\\omega_4^2\end{bmatrix}\approx\begin{bmatrix}1&1&1&1\\0&1&0&-1\\1&0&-1&0\\1&-1&1&-1\end{bmatrix}\begin{bmatrix}p_1\\p_2\\p_3\\p_4\end{bmatrix} \tag{15}$$

Where $P_1,P_2,P_3,P_4$ are the motors power. Motors power can then be found from the auxiliary variables as follows $$\begin{bmatrix}p_1\\p_2\\p_3\\p_4\end{bmatrix}=\begin{bmatrix}1&0&2&1\\1&2&0&-1\\1&0&-2&1\\1&-2&0&-1\end{bmatrix}\begin{bmatrix}u_1\\u_2\\u_3\\u_4\end{bmatrix}=\Gamma U \tag{16}$$

The matrix Γ maps the auxiliary control actions U, to the proper individual motor control command signal.

The first control loop comprises an ROP controller method 701 which produces a control action 721 corresponding to the auxiliary variable $u_1$. The produced action is based on the error between the desired ROP_D 709 and the actual ROP 719. The control action is modified based on the Force On Bi FOB 741, as measured by the MWL instruments 720. The loop action is adjusted based on the available FOB, as usually the motors are not enough to achieve the required ROP.

The second control loop comprises an inclination controller method 702 which produces a control action 722 corresponding to the auxiliary variable $u_2$. The produced action is based on the error between the desired inclination angle $\theta_D$ 706 and the actual inclination $\theta_A$ 716. The actual inclination is obtained from the MWD 720.

The third control loop comprises an azimuth angle controller method 703 which produces a control action 723 corresponding to the auxiliary variable $u_3$. The produced action is based on the error between the desired azimuth angle $\psi_D$ 707 and the actual inclination $\psi_A$ 717. The actual azimuth is obtained from the MWD 720.

The fourth control loop comprises a Roll angle controller method 704 which produces a control action 724 corresponding to the auxiliary variable $u_4$. The produced action is based on the error between the desired Roll angle $\varphi_D$ 708 and the actual roll angle $\varphi_A$ 718. The actual roll angle is obtained from the MWD 720.

The control actions {u1,u2,u3,u4} are then transformed by the matrix Γ 710 into the motor control commands P1 711, P2 712, P3 713, and P4 714, and transmitted to the motors and motor drivers 731 in the BHA 705. The control loops adjust the control actions in the presence of many operation and environment factors. Environmental Factors include: depth and formation (rock) properties, while operational factors include Bit Wear State, Bit Design, Mud properties, mud flow rate, Bottom hole Mud Pressure, and weight on bit.

Figure 9:
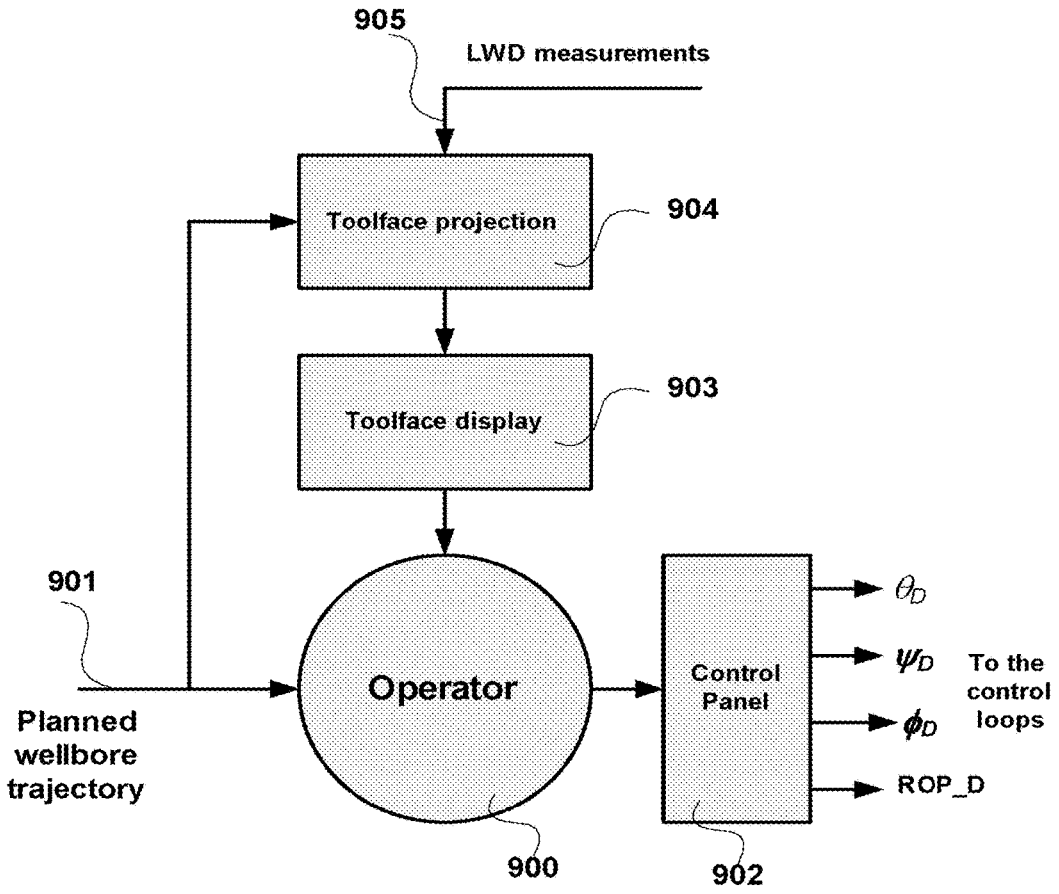
FIG. 9 depicts manual steering components and procedure.

FIG. 9 is a diagram depicting the manual steering components and procedures. In manual steering the operator is positioned on a control room at the surface, reacts with a display screen and a steering command board. The quad rotors and the proposed control loops provide a simple and intuitive man-machine interface and simplifies the steering task. The interaction is through touch screen as well as an operating console comprising of a joy stick and sliding levers and/or rotating knobs.

As illustrated in FIG. 9, the task of the operator 900 is to steer the BHA in accordance with a preplanned well bore trajectory 901 prepared by the geologists and petroleum engineers. Based on the toolface display 903, the operator interacts with the control panel 902 to issue the control loops set points, $\{\theta_D, \psi_D, \varphi_D, \text{ROP_D}\}$. The issued set points are gradual and incremental changes to close the errors between the actual and planned wellbore trajectory. LWD measurements 905 are sent to the toolface projection 904. The tool face projection 904, calculates the projection of the direction of desired trajectory relative to the directional of the drilling head projected on the {U,V} plane of the BHA. The projection is performed as follows.

Suppose that a unit vector in the direction of the planned trajectory at the current drill position {x,y,z} is given by:

$$d_D = \begin{bmatrix} c\psi_D s\theta_D \\ s\psi_D s\theta_D \\ c\theta_D \end{bmatrix} \tag{17}$$

The projection of the desired direction on the BHA body axis {U,V,W} is then given by:

$$d_{Duvw} = \begin{bmatrix} c\psi c\theta c\phi - s\psi s\phi & s\psi c\theta c\phi + c\psi s\phi & -s\theta c\phi \\ -c\psi c\theta\, s\phi - s\psi c\phi & -s\psi c\theta s\phi + c\psi c\phi & s\theta s\phi \\ c\psi s\theta & s\psi s\theta & c\theta \end{bmatrix} \begin{bmatrix} c\psi_D s\theta_D \\ s\psi_D s\theta_D \\ c\theta_D \end{bmatrix} \tag{18}$$

According the projection of the desired direction on the {U,V} plane is given by the coordinate $\{d_{Du}, d_{Dv}\}$ as follows:

$$d_{Du} = (c\psi c\theta c\varphi - s\psi s\varphi)(c\psi_D s\theta_D) + (s\psi c\theta c\varphi + c\psi s\varphi)(s\psi_D s\theta_D) + (-s\theta c\varphi)(c\theta_D) \tag{19}$$

$$d_{Dv} = (-c\psi c\theta s\varphi - s\psi c\varphi)(c\psi_D s\theta_D) + (-s\psi c\theta s\varphi + c\psi c\varphi)(s\psi_D s\theta_D) + (s\theta s\varphi)(c\theta_D) \tag{20}$$

Figure 10:
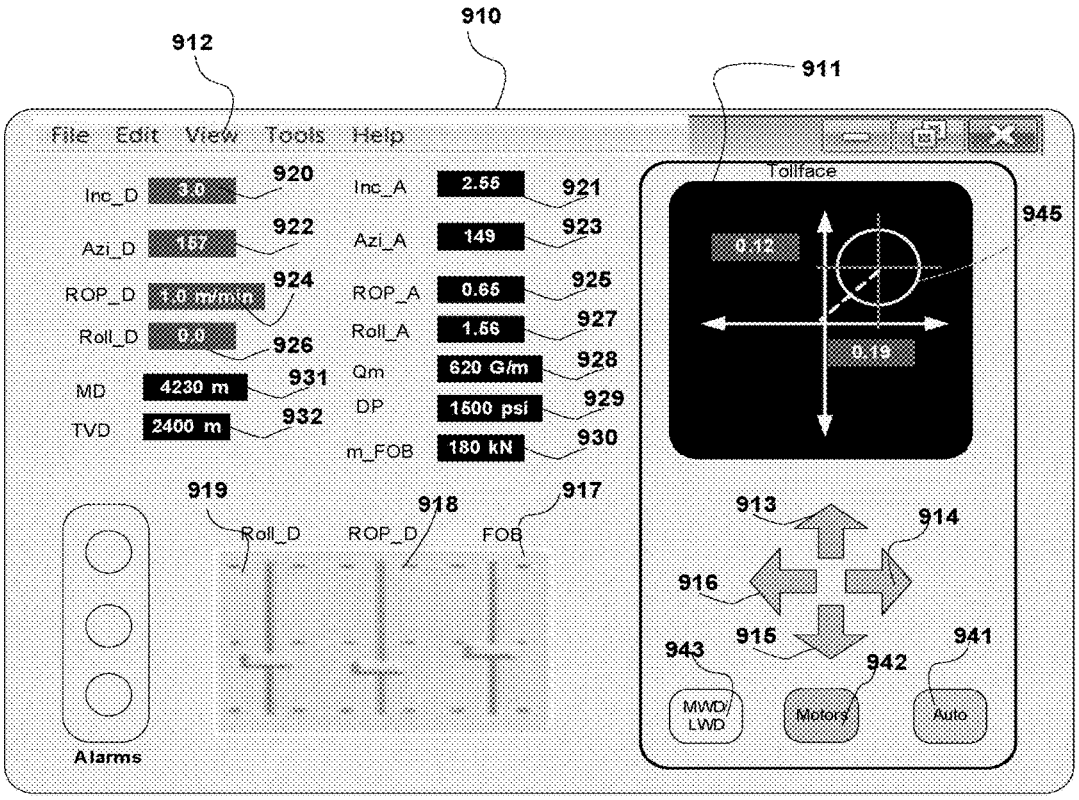
FIG. 10 depicts display window of an MMI operator.

An example of the operator command window is shown in FIG. 10. The operator performs the steering task with the help of the command window as displayed in FIG. 10. The window 910 includes the toolface display 911, and standard window tool bar 912. The toolface display indicates the direction of the desired wellbore trajectory, indicated by crosshair 945, relative of the BHA fixed axes {U,V}. The display indicates the deviation of the current BHA direction from the desired direction. The operator can then issue steering commands using optionally the on-screen arrows or using the control panels. The right arrow 914 will cause the rotations per minute of the left/right motors to increase/decrease their rpm. The increase/decrease in the left/right motors rpm steers the drilling head to the right direction modifying the azimuth angle. Similarly the left arrow 916 steers the drilling head in the left direction. The up arrow 913 and the down arrow 915 steer the drilling head up and down modifying the inclination angle of the drilling head.

The command window displays additional drilling parameters. 920 is the desired inclination at the current position, while 921 displays the actual inclination angle of the BHA. Similarly 922 displays the desired azimuth angle, and 923 displays the actual azimuth angle of the BHA. The desired ROP, is displayed in 924, and the current ROP is displayed in 925. The desired roll angle is displayed in 926, and the actual roll angle is displayed in 927. Additional drilling parameters are also indicated as the drilling fluid (mud) flow rate 928, bottom differential pressure 929, measured force on bit FOB 930, the Measured Depth MD 931, and the True Vertical Depth TVD 932.

The operator can easily switch between different windows or display them on the same screen. The soft bottom 942 will switch the window to the motor status display. The motors status window displays various status and alarm limits for each motors, e.g., the rpm of each motor, the torque of each motor, temperatures, as well as the alarm limits. It also displays the status of the mud fluid pump, flow rate, surface pressure, etc. as well as control inputs for supervisory control. The soft bottom 943 invokes the MWD/LWD status window. This window displays relevant measures and inferred formation data, e.g. matrix density, porosity, resistivity, which help the operator to steer the drilling head to stay within a desired formation. The soft button switch 941 puts the control loops under Automatic mode. The slider 917 may send requests to the surface rig to adjust the FOB. The slider 918 may adjust the ROP set point. The slider 919 may adjust the roll position of the drilling head or set it to a default of zero.

In the automatic mode, every 100 ft, the desired target azimuth and inclination values for the next 100 feet (10 meters) are obtained from the planned wellbore trajectory. These values are then compared with the current attitude of the BHA. The error is then linearly interpolated over the next 100 feet to obtain the desired values of the inclination and azimuth angles to be given as set points to the control loops to be updated every 10 seconds. In the automatic mode, the set point of the roll angle is zero and the control loop will stabilize the drilling head against any roll rotations. The ROP set point is taken to be the last value set by the operator.

Figure 11:
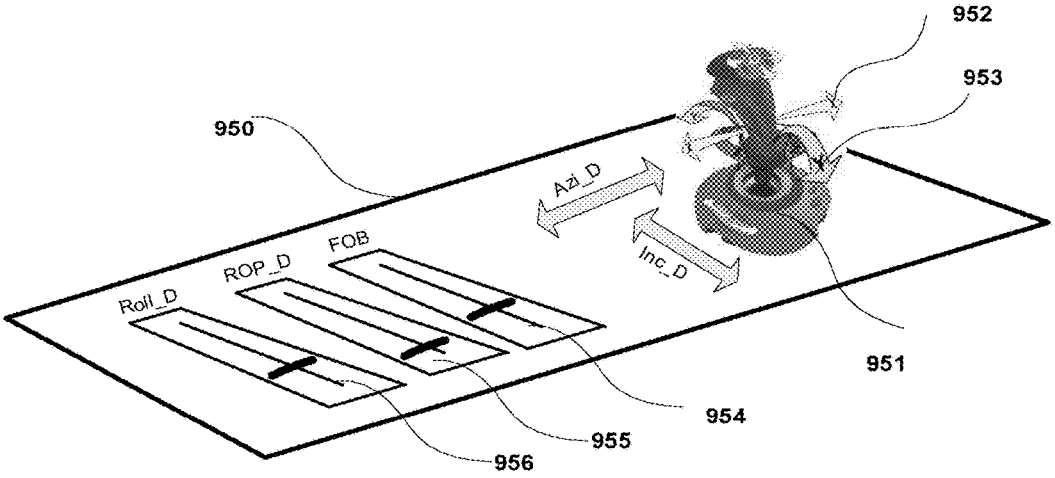
FIG. 11 depicts a control panel.

FIG. 11 depicts the control panel. The control panel 950 includes a joystick 951, where the left/right movement 952 corresponds to drilling head azimuth movements, and the joystick front/back movements 953 corresponds to the drilling head inclination movements. The amount of the deviation of the joystick from the neutral position generates a proportional point commands to the steering control loops. The controlling panel comprises sliding or rotary control for other control commands. The slider 954 could send requests to the surface rig to adjust the FOB. ROP set point can be adjusted by the slider 955. The slider 956 can be used to change the roll position of the drilling head or to set it to zero (the default case). The ability to change the roll position of the head is useful to smooth the bore hole internal surface or to mitigate any clogging situation.

Another embodiment of the invention includes a control method to simplify the steering task by translating the operator commands to control the four motors to follow the desired wellbore trajectory.

Another embodiment of the invention includes an operator display and interface comprising a control panel to make the new controls to be conveniently available to the drilling operators. Traditional control panels do not include such control panels.

Another embodiment includes a fully automated system wherein the control commands for the four motors are generated by a trajectory tracking algorithm. The trajectory tracking algorithm is within the operational constrains of the drilling assembly.

Figure 12:
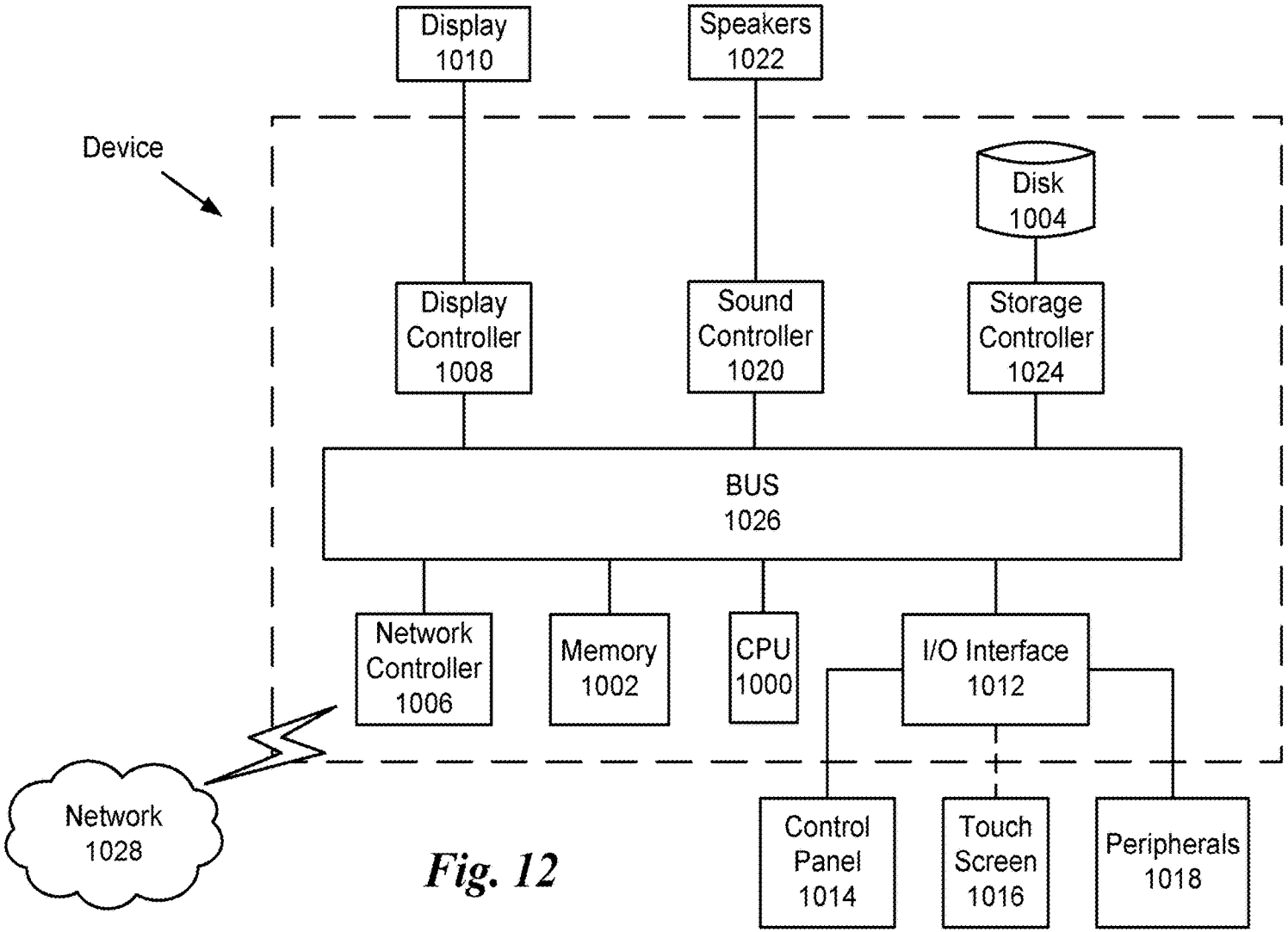
FIG. 12 depicts hardware elements of the control unit.

Next, a hardware description of a computer and/or network system according to exemplary embodiments is described with reference to FIG. 12. In FIG. 12, the computer and/or network system includes a CPU 1000 which performs the processes described above. The process data and instructions may be stored in memory 1002. These processes and instructions may also be stored on a storage medium disk 1004 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the control panel communicates, such as a server or computer.

Further, the claimed advancements may be provided as a utility application, background daemon, or component of an operating system, or combination thereof, executing in conjunction with CPU X00 and an operating system such as Microsoft Windows 7, UNIX, Solaris, LINUX, Apple MAC-OS and other systems known to those skilled in the art.

CPU 1000 may be a Xenon or Core processor from Intel of America or an Opteron processor from AMD of America, or may be other processor types that would be recognized by one of ordinary skill in the art. Alternatively, the CPU 1000 may be implemented on an FPGA, ASIC, PLD or using discrete logic circuits, as one of ordinary skill in the art would recognize. Further, CPU 1000 may be implemented as multiple processors cooperatively working in parallel to perform the instructions of the inventive processes described above.

The computer and/or network system in FIG. 12 also includes a network controller 1006, such as an Intel Ethernet PRO network interface card from Intel Corporation of America, for interfacing with network 1028. As can be appreciated, the network 1028 can be a public network, such as the Internet, or a private network such as an LAN or WAN network, or any combination thereof and can also include PSTN or ISDN sub-networks. The network 1028 can also be wired, such as an Ethernet network, or can be wireless such as a cellular network including EDGE, 3G and 4G wireless cellular systems. The wireless network can also be WiFi, Bluetooth, or any other wireless form of communication that is known.

The computer and/or network system further includes a display controller 1008, such as a NVIDIA GeForce GTX or Quadro graphics adaptor from NVIDIA Corporation of America for interfacing with display 1010, such as a Hewlett Packard HPL2445w LCD monitor. A general purpose I/O interface 1012 interfaces with a control panel 1014 as well as a touch screen panel 1016 on or separate from display 1010. General purpose I/O interface also connects to a variety of peripherals 1018 including printers and scanners, such as an OfficeJet or DeskJet from Hewlett Packard.

A sound controller 1020 is also provided in the [device], such as Sound Blaster X-Fi Titanium from Creative, to interface with speakers/microphone 1022 thereby providing sounds and/or music, and audible warnings and alarms.

The general purpose storage controller 1024 connects the storage medium disk 1004 with communication bus 1026, which may be an VME, PXI, cPCI, ePCI, or similar, for interconnecting all of the components of the control panel. A description of the general features and functionality of the display 1010, control panel 1014, as well as the display controller 1008, storage controller 1024, network controller 1006, sound controller 1020, and general purpose I/O interface 1012 is omitted herein for brevity as these features are known.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, define, in part, the scope of the foregoing claim terminology such that no inventive subject matter is dedicated to the public.

The invention claimed is:

1. A directional drilling system comprising:

a drilling head assembly connected to a drilling string, wherein the drilling head assembly comprises a motor control unit, a log while drilling unit and four or more independently controlled motors wherein each motor is connected to a respective drill bit assembly, wherein:

a top motor drives a top drill bit assembly;

a bottom motor drives a bottom drill bit assembly;

a left motor drives a left drill bit assembly;

a right motor drives a right drill bit assembly;

wherein all of the drill bit assemblies are coplanar on a front face of the directional drilling assembly;

wherein two of the motors each rotates their respective drill bit assembly clockwise and two of the motors each rotates their respective drill bit assembly counterclockwise to control the roll angle of the drilling head assembly in a bore hole;

the drilling string attached to the drilling head assembly and containing an inner pipe to transport a drilling fluid to the drilling head assembly, and a drilling head control panel to translate steering commands in the form of an inclination angle, an azimuth angle, a roll position and a rate of penetration to the motors.

2. The directional drilling system of claim 1, wherein the motors are hydraulic motors.

3. The directional drilling system of claim 1, wherein the motors are electric motors.

4. The directional drilling system of claim 1 wherein;

the motors of the drilling head assembly control an inclination movement by decreasing or increasing a speed of the bottom motor driving the bottom drill bit assembly and the top motor driving the top drill bit assembly; and the drilling head assembly controls an azimuth movement by decreasing or increasing a speed of the right motor driving the right drill bit assembly and the left motor driving the left drill bit assembly.

5. The directional drilling system of claim 1, wherein the drilling head control panel comprises;

a first control loop configured to force the bottom drilling head and the top drilling head to follow a desired inclination angle set point;

a second control loop configured to force the left drilling head and the right drilling head to follow a desired azimuth angle set point;

a third control loop configured to force the drilling head to follow a desired roll angle set point; and a fourth control loop configured to force the drilling head to follow a desired rate of penetration.

6. The directional drilling system of claim 1, wherein the drilling head control panel comprises comprising:

at least one joystick;

wherein the joystick is configured with a joystick forward position and a joystick reverse position linked proportionally to a set point of an inclination angle control loop;

wherein the joystick is configured with a joystick right position and a joystick left position proportionally linked to the set point of an azimuth angle control loop; and one or more sliding sticks or rotary knobs for changing the set points of a roll angle control loop and a rate of penetration control loop.

7. A method for drilling a borehole with the directional drilling system of claim 1, comprising:

driving the drilling head assembly to drill the borehole into a geologic formation with the motors;

rotating two of the motors clockwise, while rotating two of the other motors counterclockwise;

controlling a roll angle of the drilling head assembly in the bore hole responsive to the rotation of the motors;

transporting a drilling fluid to the drilling head assembly through the drilling string and the inner pipe of the drilling head assembly, wherein the drilling fluid provides hydraulic power to rotate the motors.

8. The method of claim 7, further comprising:

translating steering commands in the form of a desired inclination angle, a desired azimuth angle, a desired roll position, and a desired rate of penetration of the individual motors to the drilling head assembly with a drilling head control panel.

9. The method of claim 7, further comprising:

controlling an inclination movement of the drilling head assembly by decreasing or increasing a speed of the bottom motor and the top motor;

controlling an azimuth movement by decreasing or increasing a speed of the right motor and the left motor.

* * * * *